US009147968B2

(12) United States Patent
Nagasaka et al.

(10) Patent No.: US 9,147,968 B2
(45) Date of Patent: Sep. 29, 2015

(54) CONNECTOR WITH LOCKING LANCE

(75) Inventors: Naokazu Nagasaka, Shizuoka (JP); Hiromasa Kubota, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 62 days.

(21) Appl. No.: 13/981,546

(22) PCT Filed: Mar. 26, 2012

(86) PCT No.: PCT/JP2012/057828

§ 371 (c)(1),
(2), (4) Date: Jul. 24, 2013

(87) PCT Pub. No.: WO2012/133350

PCT Pub. Date: Oct. 4, 2012

(65) Prior Publication Data

US 2014/0011387 A1 Jan. 9, 2014

(30) Foreign Application Priority Data

Mar. 30, 2011 (JP) ..... 2011-075925

(51) Int. Cl.
*H01R 13/627* (2006.01)
*H01R 13/422* (2006.01)

(52) U.S. Cl.
CPC ..... *H01R 13/627* (2013.01); *H01R 13/4223* (2013.01)

(58) Field of Classification Search
CPC ..... H01R 13/6275; H01R 13/4223; H01R 13/4365
USPC ..... 439/350, 595
See application file for complete search history.

(56) References Cited

U.S. PATENT DOCUMENTS 5,008,555 A 4/1991 Mundy
5,695,368 A * 12/1997 Joly et al. ..... 439/748
6,179,660 B1 * 1/2001 Salaguinto et al. ..... 439/595
6,488,536 B2 * 12/2002 Fukamachi ..... 439/595

(Continued)

FOREIGN PATENT DOCUMENTS

CN 101436727 A 5/2009
CN 101488616 A 7/2009

(Continued)

OTHER PUBLICATIONS

Written Opinion for PCT Patent App. No. PCT/JP2012/057828.

(Continued)

*Primary Examiner* — Hae Moon Hyeon
(74) *Attorney, Agent, or Firm* — Kenealy Vaidya LLP

(57) ABSTRACT

In a connector of the invention, a female housing 30 which is adapted to accommodate a female connector terminal includes a female terminal locking lance (32) which prevents the dislocation of a female connector terminal accommodated in a female terminal accommodation hole (31), a tab insertion opening (33) through which a tab is inserted into a terminal fitting portion of the female connector terminal held in the female terminal accommodation hole (31), and a tapered guide surface (34) which is formed on an opening edge of the tab insertion opening (33), and further, the female terminal locking lance (32) is formed so as to deviate in a widthwise direction of the female connector terminal with respect to a center axis (C31) of the female terminal accommodation hole (31).

6 Claims, 18 Drawing Sheets

(56) References Cited

U.S. PATENT DOCUMENTS

| | | | | |
|---|---|---|---|---|
| 6,648,685 | B2 * | 11/2003 | Nankou | 439/595 |
| 6,905,376 | B2 * | 6/2005 | Chen | 439/852 |
| 7,458,863 | B2 * | 12/2008 | Shimizu | 439/842 |
| 7,614,904 | B2 * | 11/2009 | Hiramatsu | 439/489 |
| 8,052,489 | B2 * | 11/2011 | Mase et al. | 439/752 |
| 2004/0087209 | A1 | 5/2004 | Nakamura | |
| 2006/0172615 | A1 | 8/2006 | Noro et al. | |
| 2006/0172619 | A1 | 8/2006 | Kobayashi et al. | |
| 2009/0124114 | A1 | 5/2009 | Ishikawa | |
| 2009/0186512 | A1 | 7/2009 | Adachi et al. | |
| 2009/0191747 | A1 | 7/2009 | Tanaka et al. | |
| 2010/0136819 | A1 * | 6/2010 | Mase et al. | 439/345 |
| 2010/0273366 | A1 * | 10/2010 | Okano | 439/877 |
| 2011/0008989 | A1 * | 1/2011 | Amano et al. | 439/357 |

FOREIGN PATENT DOCUMENTS

| | | | |
|---|---|---|---|
| CN | 101499579 | A | 8/2009 |
| JP | 2004-152583 | A | 5/2004 |
| JP | 2006-19076 | A | 1/2006 |
| JP | 2006-216313 | A | 8/2006 |
| JP | 2006-216316 | A | 8/2006 |
| JP | 2006-216324 | A | 8/2006 |

OTHER PUBLICATIONS

International Search Report and Written Opinion of the International Search Report for PCT/JP2012/057828 dated Jun. 12, 2012.

Japanese Office Action for the related Japanese Patent Application No. 2011-075925 dated Nov. 18, 2014.

Chinese Office Action for the related Chinese Patent Application No. 2012800111893 dated Feb. 27, 2015.

* cited by examiner

CONNECTOR WITH LOCKING LANCE

TECHNICAL FIELD

The present invention relates to a connector in which a female terminal locking lance is equipped in a first housing adapted to accommodate and hold a female connector terminal for preventing the dislocation of a female connector terminal accommodated therein.

BACKGROUND ART

Various types of connectors have been proposed in which a female terminal locking lance is equipped in a first housing adapted to accommodate and hold a female connector terminal for preventing the dislocation of a female connector terminal accommodated therein.

FIG. 15 shows the construction of a distal end portion of a first housing 101 of a connector of this type. In the case of the connector of this type, as also disclosed in Patent Literature 1 below, a tab insertion opening 102 and tapered guide surfaces 103 are provided at the distal end portion of the first housing 101.

The tab insertion opening 102 is a hole through which a tab of a male tab terminal is inserted into a terminal fitting portion of a female connector terminal which is held in a female terminal accommodation hole 111 in the first housing 101. The tab insertion opening 102 is formed so as to communicate with a distal end of the female terminal accommodation hole 111.

The guide surfaces 103 are tapered surfaces which guide the tab to the center of the tab insertion opening 102 when the tab of the male tab terminal is inserted into the tab insertion hole 102. The guide surfaces 103 are formed around an opening edge of the tab insertion opening 102.

In the conventional connector, as show in FIG. 15, a female terminal locking lance 121 which prevents the dislocation of a female connector terminal is provided so that a widthwise center axis Lc thereof is caused to coincide with a center axis of the female terminal accommodation hole 111.

RELATED ART LITERATURE

Patent Literature

Patent Literature 1: JP-A-2004-152583

SUMMARY OF THE INVENTION

Problem that the Invention is to Solve

Incidentally, in the first housing 101 in which the dislocation of the female connector terminal is prevented by the female terminal locking lance 121, in order to increase the holding force for the female connector terminal, it is effective to increase the engaging area between the female connector terminal and the female terminal locking lance 121. Then, in order to increase the engaging area between the female connector terminal and the female terminal locking lance 121, it is effective to increase a widthwise dimension of the female terminal locking lance 121.

In the case of the conventional first housing 101, however, when the widthwise dimension W of the female terminal locking lance 121 is increased to near the widthwise dimension of the tab insertion opening 102, the first housing 101 will take the following shape in relation to the removal of the first housing 101 from a mold in which it is formed. Namely, as shown in FIG. 16, a guide surface 103 cannot be formed at an edge portion of the opening edge of the tab insertion opening 102 which is situated to face the female terminal locking lance 121.

As a result, as shown in FIGS. 17 and 18, when a mating second housing 201 is fitted on the first housing 101 so that a tab 231 of a male tab terminal 230 in the second housing 201 is fitted in a terminal fitting portion 131 of a female connector terminal 130 for connection within the first housing 101, the following incident is likely to occur. Namely, in the event that the tab 231 is inclined towards a lower edge side of the tab insertion opening 102 due to the connector housings to be fitted together being inclined relative to each other, as shown in FIG. 18, a distal end of the tab 231 comes into collision with a distal end of the terminal fitting portion 131, whereby a quick fitting of the tab 231 and the terminal fitting portion 131 cannot be attained.

Namely, in the case of the conventional first housing 101, when the width of the female terminal locking lance 121 is increased to increase the holding force of the female connector terminal 130 in the first housing 101, the guide surface 103 for the tab 231 cannot be formed at the lower edge portion of the tab insertion opening 102. As a result, there are fears that a reduction in fitting performance is called for due to the collision of the distal end portions of the terminals.

In other words, in the case of the conventional first housing 101, there exists a problem that the holding force of the female terminal locking lance 121 which holds the female connector terminal 130 cannot be increased without reducing the fitting performance between the female connector terminal 130 and the male tab terminal 230.

Then, the invention has been made with a view to solving the problem, and an object of the invention is to provide a connector which can increase the holding force of a lance which holds a female connector terminal without reducing the fitting performance between the female connector terminal and a male tab terminal.

Means for Solving the Problem

The object of the invention will be attained by the following configurations.

(1) A connector including a female connector terminal having at a distal end a terminal fitting portion into which a tab at a distal end of a male tab terminal is fitted for connection and a first housing which accommodates and holds the female terminal connector, the first housing including a female terminal accommodation hole which accommodates the female connector terminal, a female terminal locking lance which is provided within the female terminal accommodation hole so as to be brought into engagement with the female connector terminal to thereby prevent the dislocation of the female connector terminal, a tab insertion opening which is formed at a distal end of the housing so as to penetrate therethrough so that the tab is inserted into a terminal fitting portion of the female connector terminal which is held in the female terminal accommodation hole, and a tapered guide surface which is formed at an opening edge of the tab insertion opening, wherein, in the first housing, the female terminal locking lance is formed so as to deviate in a widthwise direction of the female connector terminal with respect to a center axis of the female terminal accommodation hole, and in the female connector terminal, a lance engagement portion where the female terminal locking lance is brought into engagement is provided so as to deviate in a terminal widthwise direction from the center axis.

(2) The connector according to (1) above, including the male tab terminal and a second housing which accommodates and holds the male tab terminal and which is fitted on the first housing for connection, and wherein the second housing includes a male terminal accommodation hole which accommodates the male tab terminal and a male terminal locking lance which is provided within the male terminal accommodation hole so as to be brought into engagement with the male tab terminal to thereby prevent the dislocation of the male tab terminal, the male terminal locking lance being formed so as to deviate in a widthwise direction of the male tab terminal with respect to a center axis of the male terminal accommodation hole, in the male tab terminal, a second lance engagement portion where the male terminal locking lance is brought into engagement is provided so as to deviate in the terminal widthwise direction from the center axis.

According to the configuration set forth under (1) above, in the first housing, the female terminal locking lance is formed so as to deviate in the widthwise direction of the female connector terminal with respect to the center axis of the female terminal accommodation hole.

Because of this, even though the width of the female terminal locking lance is increased to increase the holding force to hold the female connector terminal, it is possible to ensure the tapered guide surface which guides the tab of the male tab terminal to the center of the tab insertion hole at the lower edge portion of the opening edge of the tab insertion hole.

Consequently, even though the width of the female terminal locking lance is increased to increase the holding force of the lance which holds the female connector terminal, the reduction in fitting performance of the female connector terminal and the male tab terminal is not called for.

In other words, with the connector having the configuration set forth under (1) above, it is possible to increase the holding force of the lance which holds the female connector terminal without reducing the fitting performance between the female connector terminal and the male tab terminal.

According to the configuration set forth under (2) above, also in the second housing which accommodates the male tab terminal, the holding force to hold the male tab terminal can easily be increased by increasing the width of the male terminal locking lance which is brought into engagement with the male tab terminal.

Consequently, in both the first housing and the second housing which are fitted together for connection, the holding force to hold the connector terminal accommodated therein can be increased, as a result of which when the housings are fitted together for connection, the occurrence of an inadvertent looseness of the male tab terminal and the female connector terminal which are accommodated in the corresponding housings can be prevented, thereby making it possible to enhance the electric connectivity thereof.

Advantage of the Invention

According to the connector of the invention, even though the width of the female terminal locking lance is increased to increase the holding force of the lance to hold the female connector terminal, it is possible to ensure the tapered guide surface which guides the tab of the male tab terminal to the center of the tab insertion opening at the lower edge portion of the opening edge of the tab insertion opening.

Consequently, even though the width of the female terminal locking lance is increased to increase the holding force of the lance which holds the female connector terminal, the reduction in fitting performance between the female connector terminal and the male tab terminal is not called for.

In other words, with the connector according to the invention, the holding force of the lance which holds the female connector terminal can be increased without reducing the fitting performance between the female connector terminal and the male tab terminal.

MODE FOR CARRYING OUT THE INVENTION

Hereinafter, a preferred embodiment of a connector according to the invention will be described in detail by reference to the drawings.

FIGS. 1 to 14 show an embodiment of a connector according to the invention.

Figure 1:
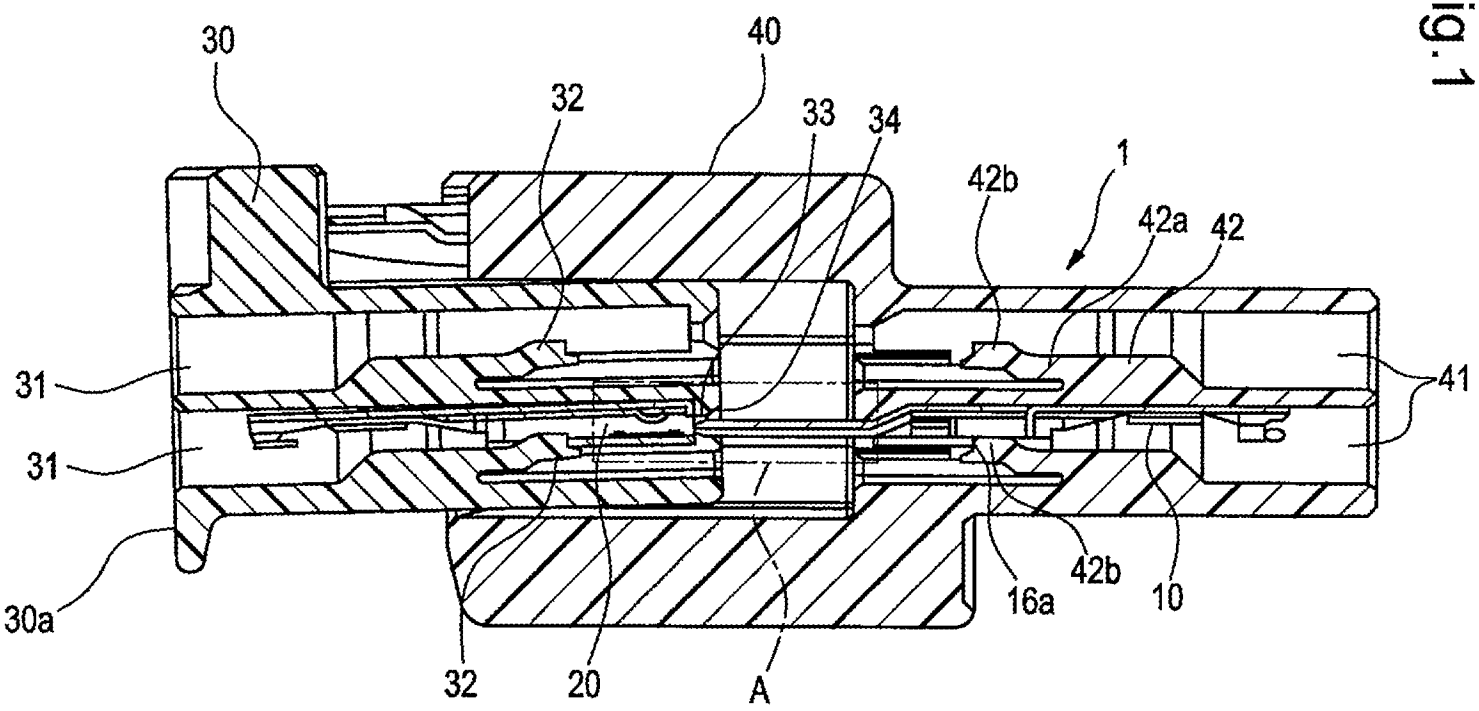
FIG. 1 is a vertical sectional view of one embodiment of a connector according to the invention.
Figure 2:
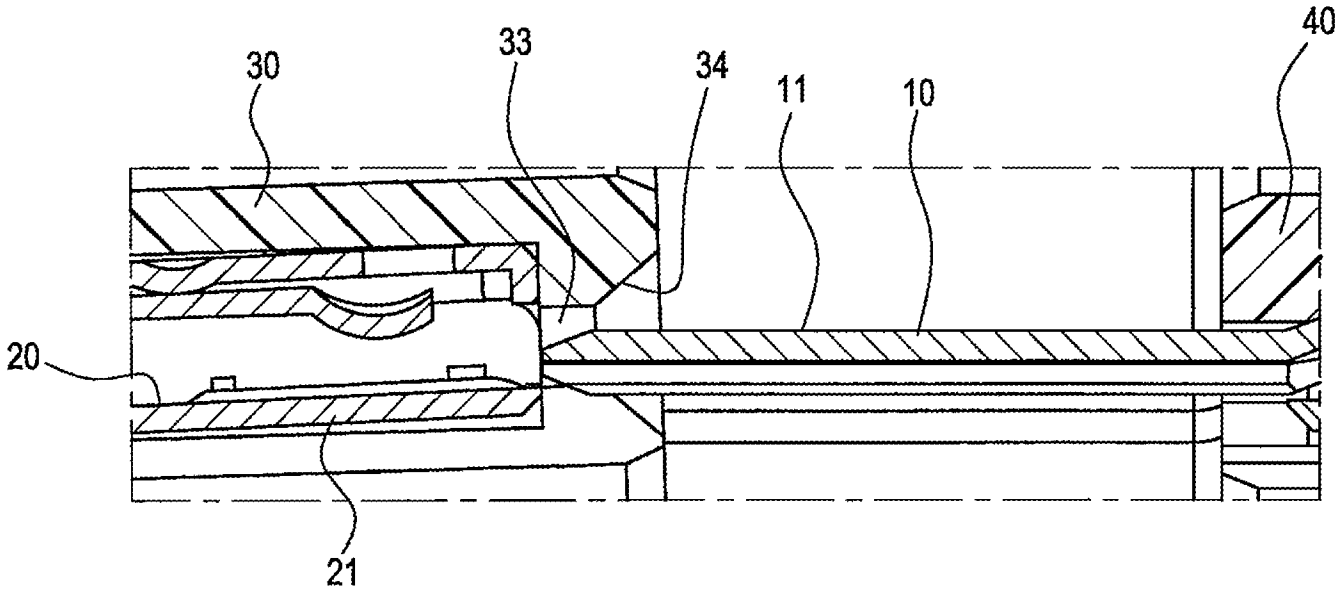
FIG. 2 is an enlarged view of a portion A in FIG. 1.
Figure 3:
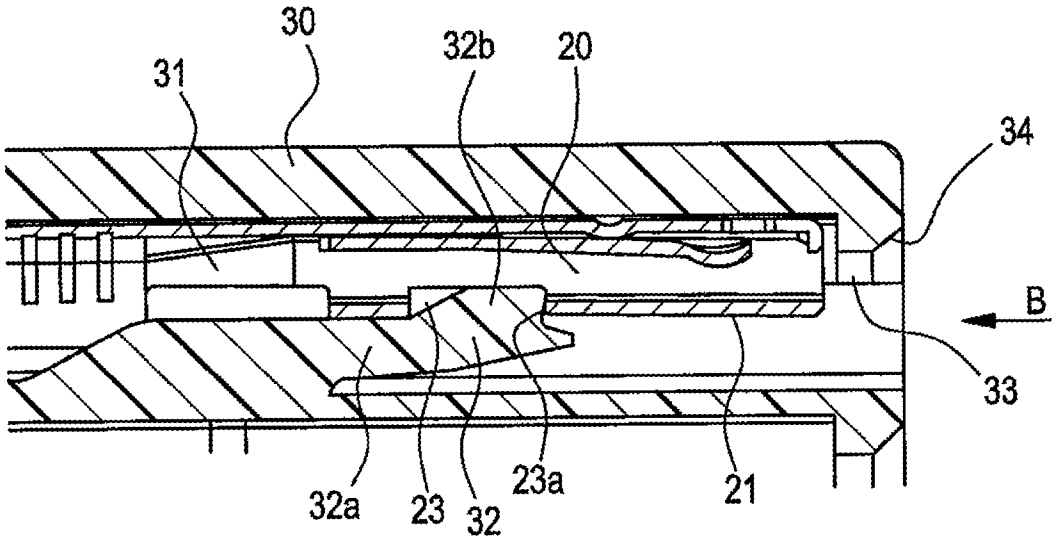
FIG. 3 is an enlarged vertical sectional view of a first housing shown in FIG. 1.
Figure 4:
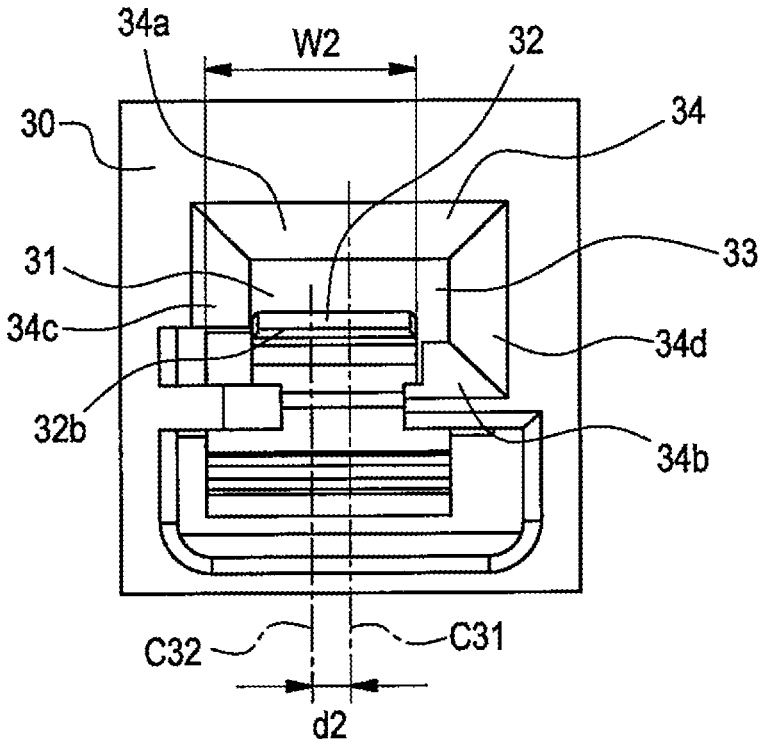
FIG. 4 is a view of the first housing as seen in a direction indicated by an arrow B in FIG. 3.
Figure 5:
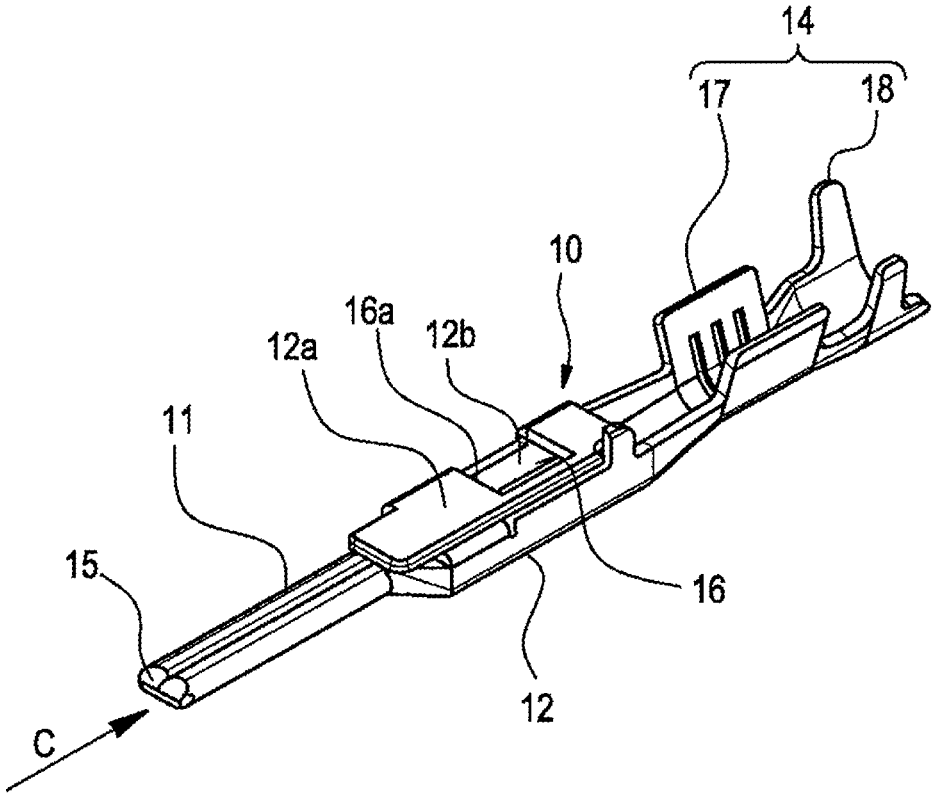
FIG. 5 is a perspective view of a male tab terminal shown in FIG. 1.
Figure 6:
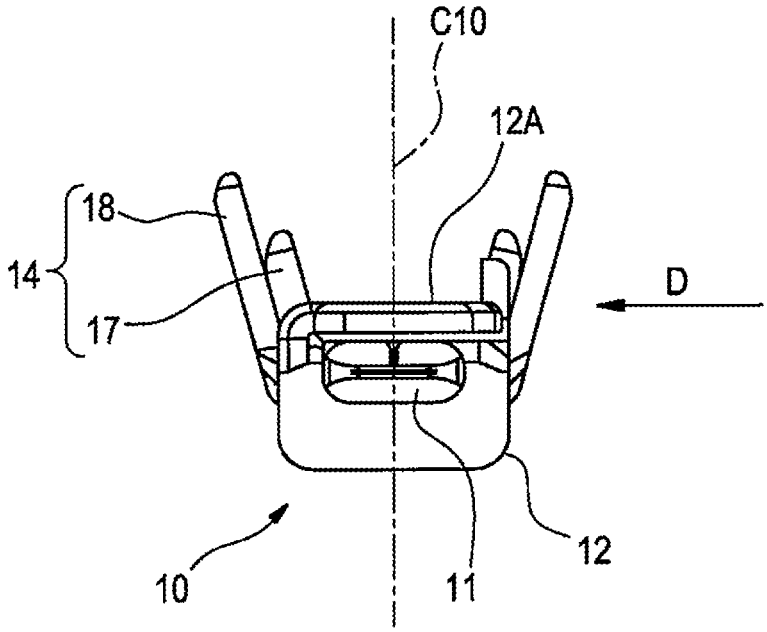
FIG. 6 is a view of the male tab terminal as seen in a direction indicated by an arrow C in FIG. 5.
Figure 7:
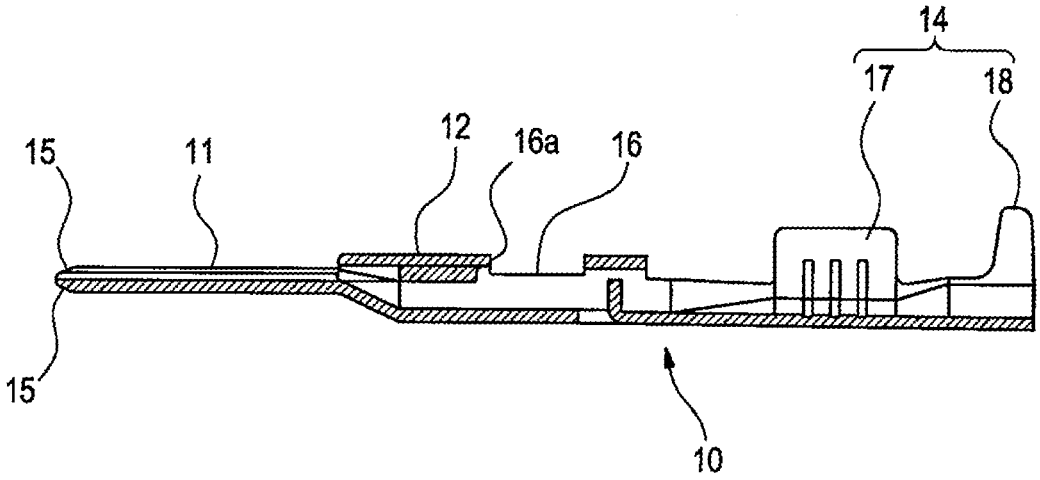
FIG. 7 is a side sectional view (a sectional view as seen in a direction indicated by an arrow D in FIG. 6) of the male tab terminal shown in FIG. 5.
Figure 8:
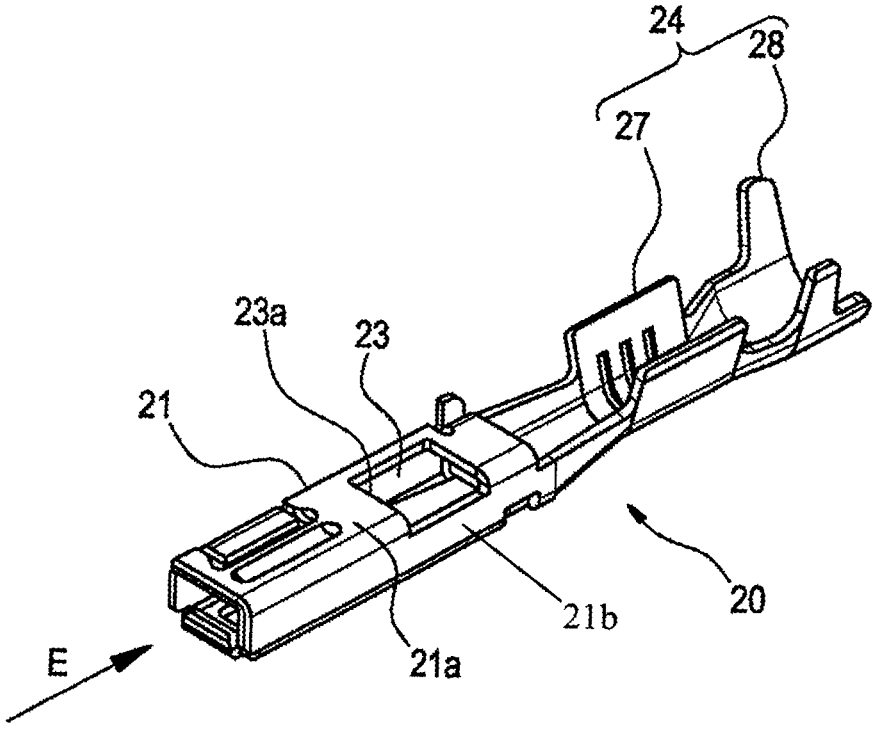
FIG. 8 is a perspective view of a female connector terminal shown in FIG. 1.
Figure 9:
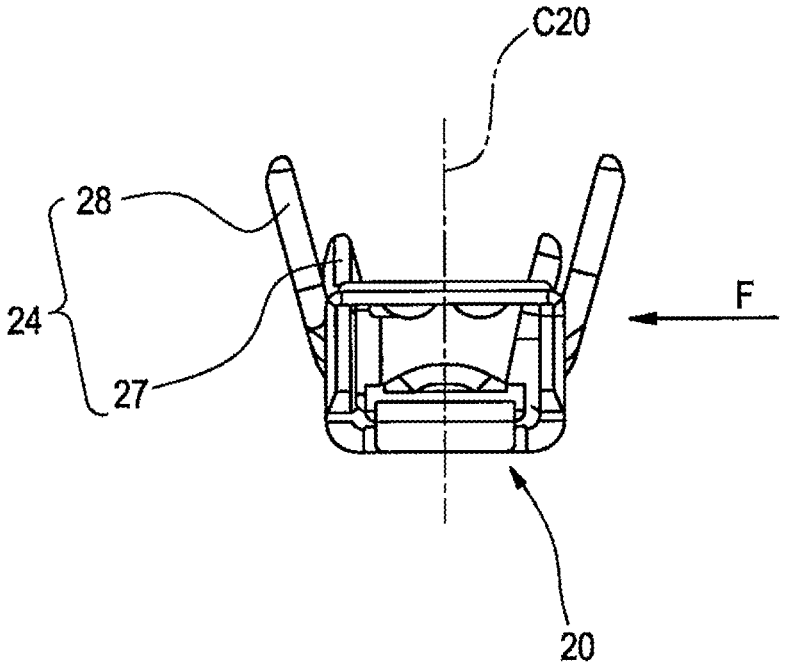
FIG. 9 is a view of the female connector terminal as seen in a direction indicated by an arrow E in FIG. 9.
Figure 10:
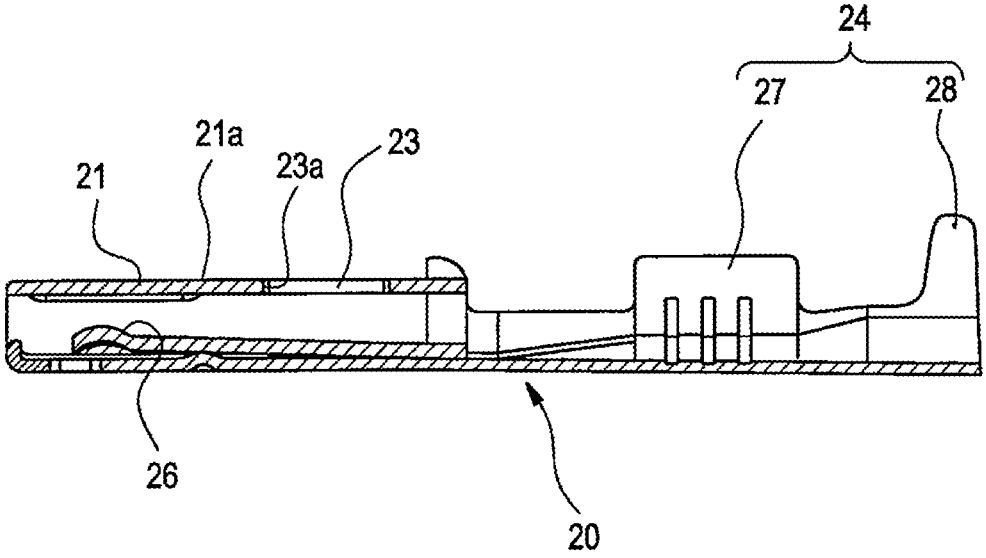
FIG. 10 is a side sectional view (a sectional view as seen in a direction indicated by an arrow F in FIG. 9) of the female connector terminal shown in FIG. 8.

FIG. 1 is a vertical sectional view of one embodiment of a connector according to the invention, FIG. 2 is an enlarged view of a portion A in FIG. 1, FIG. 3 is an enlarged vertical sectional view of a first housing shown in FIG. 1, FIG. 4 is a view of the first housing as seen in a direction indicated by an arrow B in FIG. 3, FIG. 5 is a perspective view of a male tab terminal shown in FIG. 1, FIG. 6 is a view of the male tab terminal as seen in a direction indicated by an arrow C in FIG. 5, FIG. 7 is a side sectional view (a sectional view as seen in a direction indicated by an arrow D in FIG. 6) of the male tab terminal shown in FIG. 5, FIG. 8 is a perspective view of a female connector terminal shown in FIG. 1, FIG. 9 is a view of the female connector terminal as seen in a direction indicated by an arrow E in FIG. 9, and FIG. 10 is a side sectional view (a sectional view as seen in a direction indicated by an arrow F in FIG. 9) of the female connector terminal shown in FIG. 8.

Figure 11:
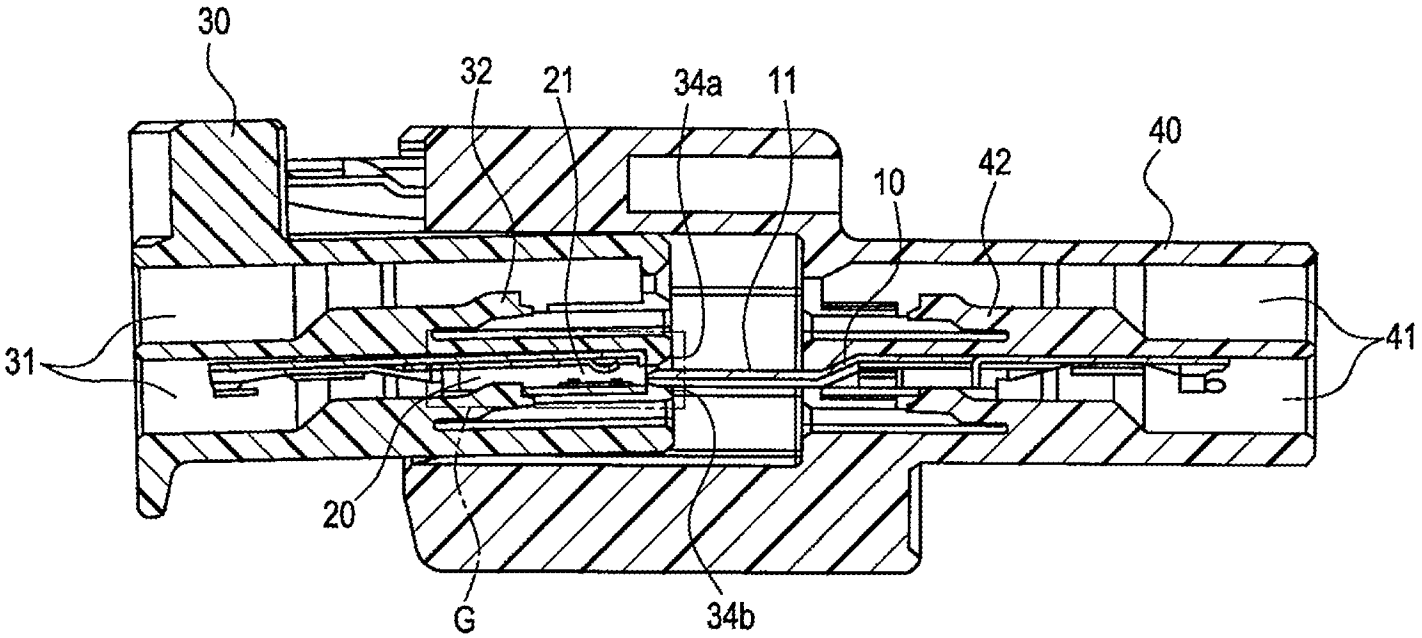
FIG. 11 is a vertical sectional view showing a state in which when the first housing and a second housing which are described in the embodiment are fitted together for connection with respective axes inclined in a vertical direction (a top-to-bottom direction), a tab of the male tab terminal within the second housing is smoothly guided into a terminal fitting portion of the female connector terminal by a tapered guide surface of the first housing.
Figure 12:
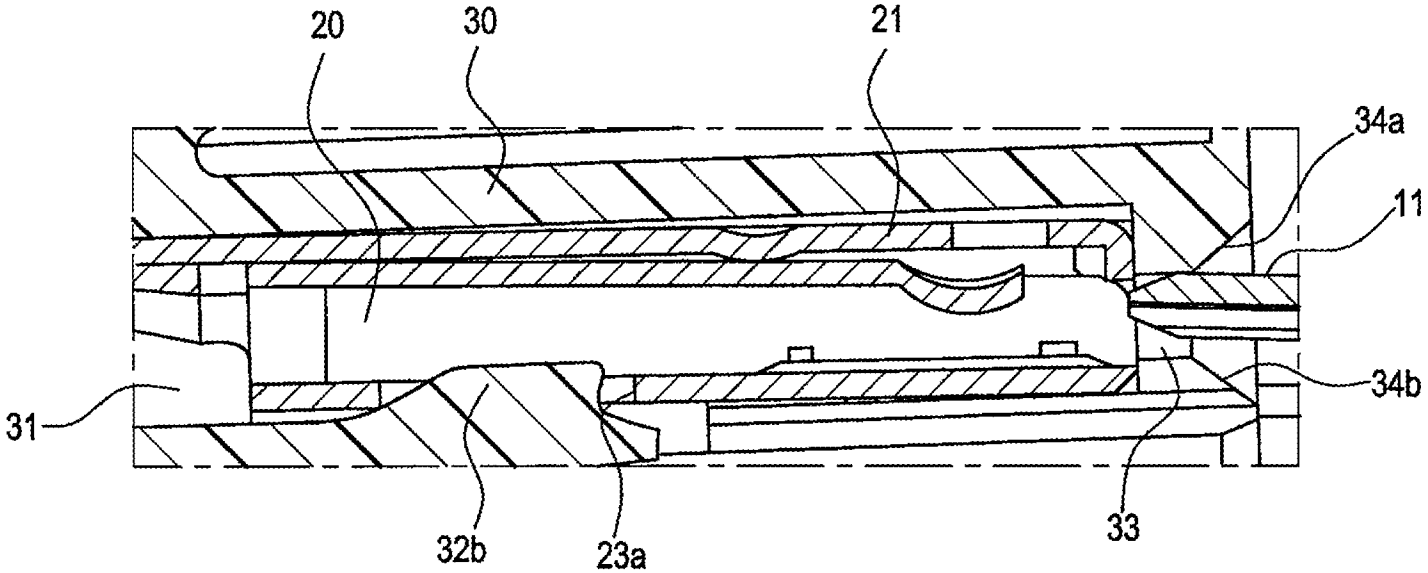
FIG. 12 is am enlarged view of a portion G shown in FIG. 11.
Figure 13:
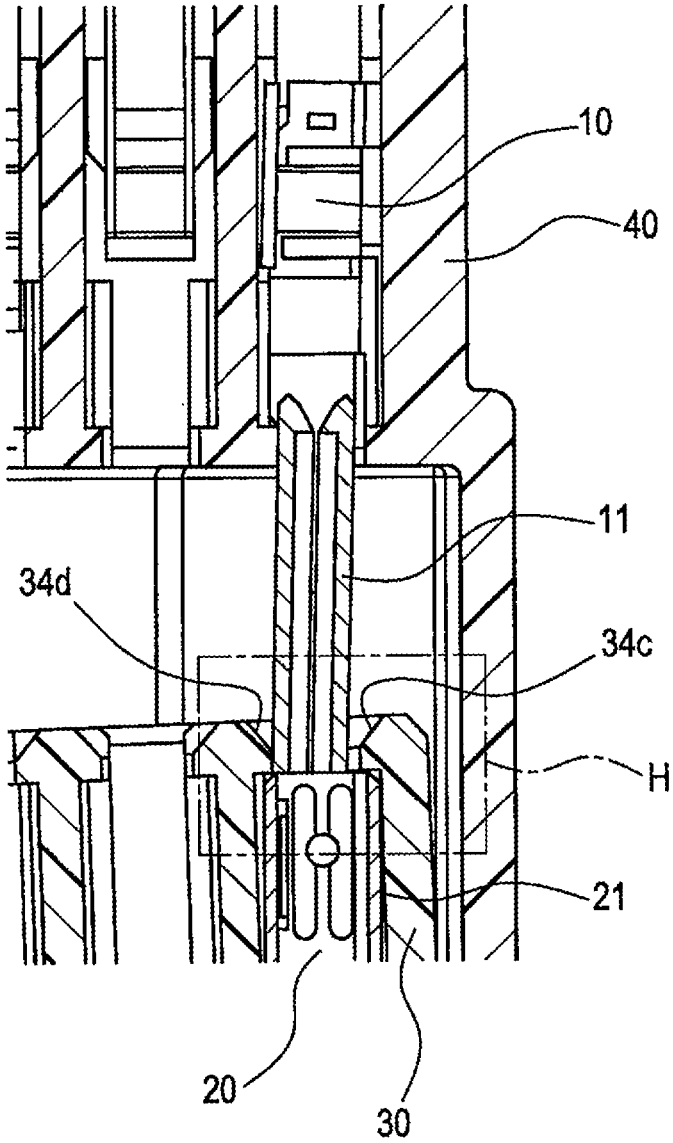
FIG. 13 is a horizontal sectional view showing a state in which when the first housing and the second housing which are described in the embodiment are fitted together for connection with the respective axes inclined in a horizontal direction (a widthwise direction), the tab of the male tab terminal within the second housing is smoothly guided into the terminal fitting portion of the female connector terminal by a tapered guide surface of the first housing.
Figure 14:
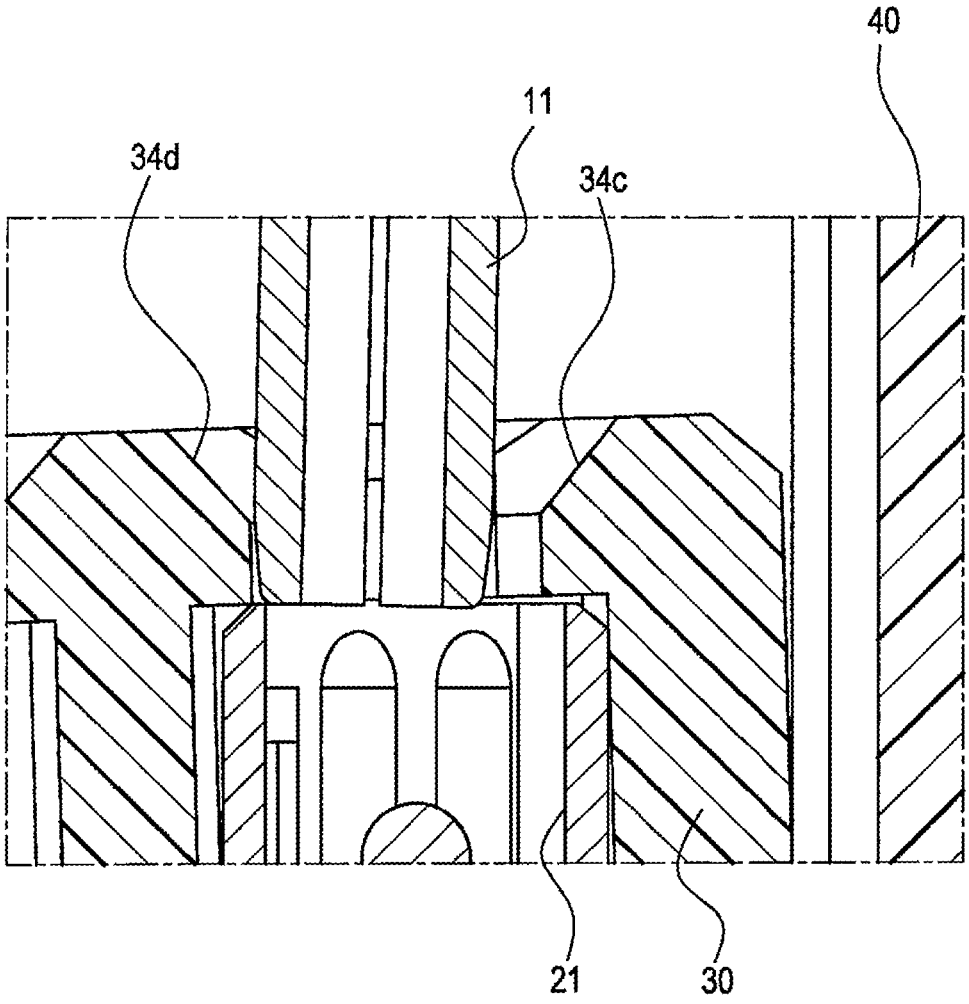
FIG. 14 is an enlarged view of a portion H shown in FIG. 13.
Figure 15:
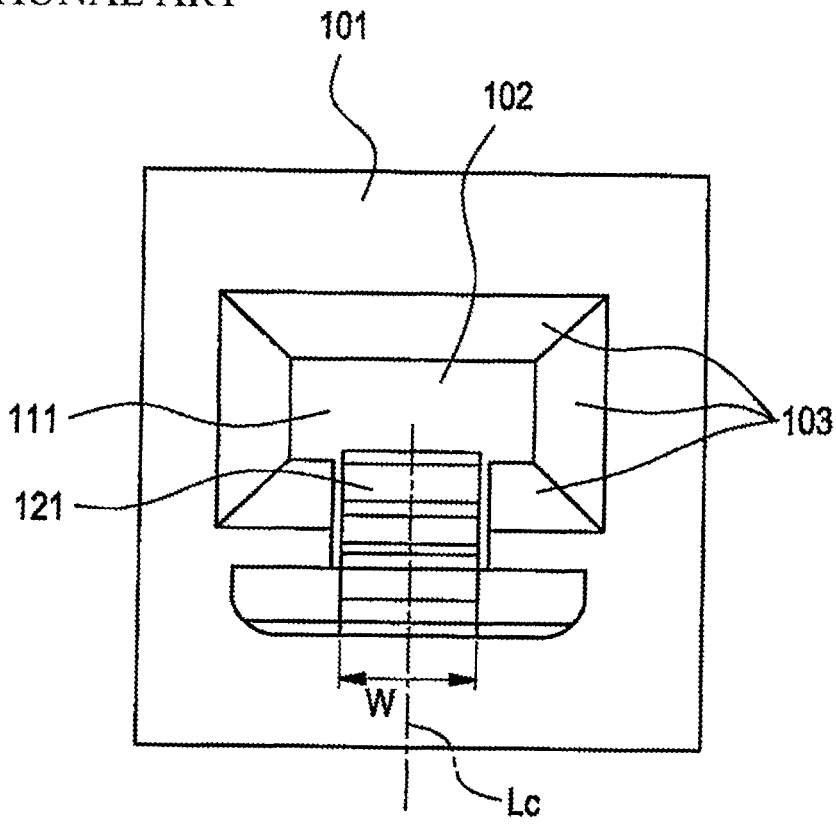
Fig.15 CONVENTIONAL ART
FIG. 15 is a front view of a main part of a conventional connector showing a relation between a tab insertion opening and a female terminal locking lance in a first housing of the conventional connector.
Figure 16:
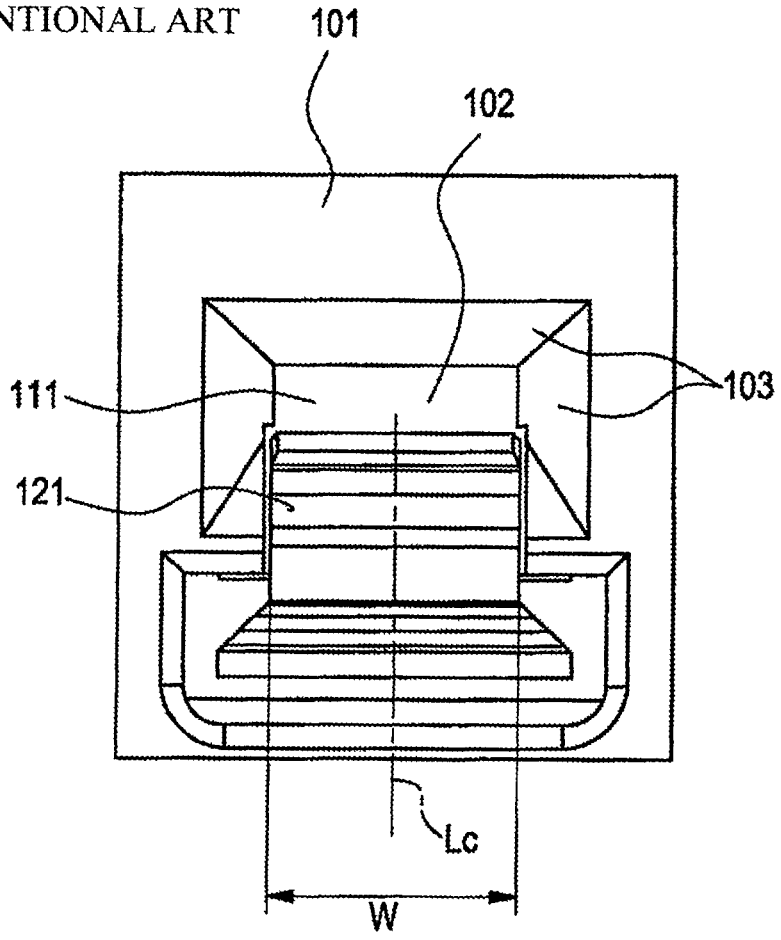
Fig.16 CONVENTIONAL ART
FIG. 16 is a front view of the main part of the conventional connector showing a case where a width of the female terminal locking lance is increased in the first housing shown in FIG. 15.
Figure 17:
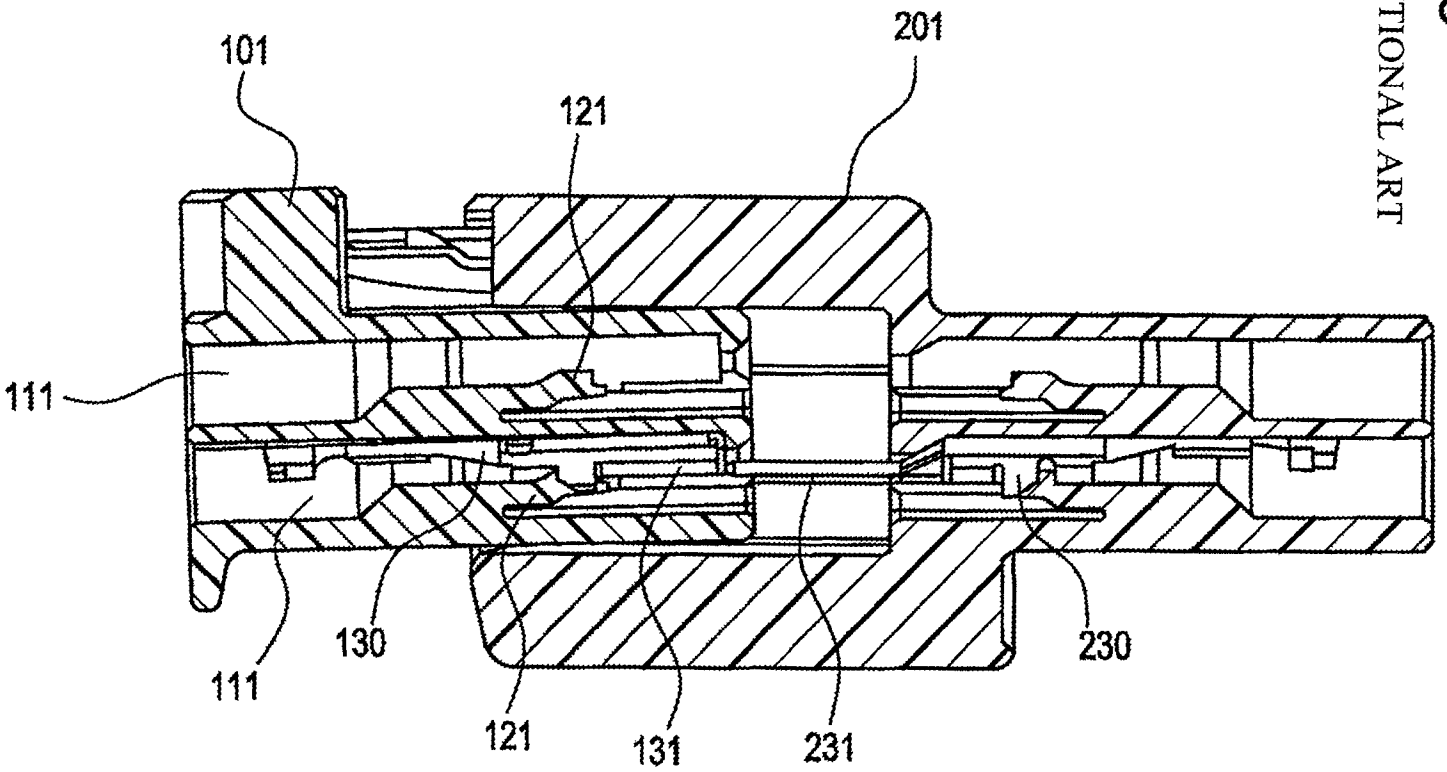
Fig.17 CONVENTIONAL ART
FIG. 17 is a vertical sectional view showing a problem which is caused when a second housing which holds a male tab terminal is fitted on the first housing in which the width of the female terminal locking lance is increased as shown in FIG. 16 for connection.
Figure 18:
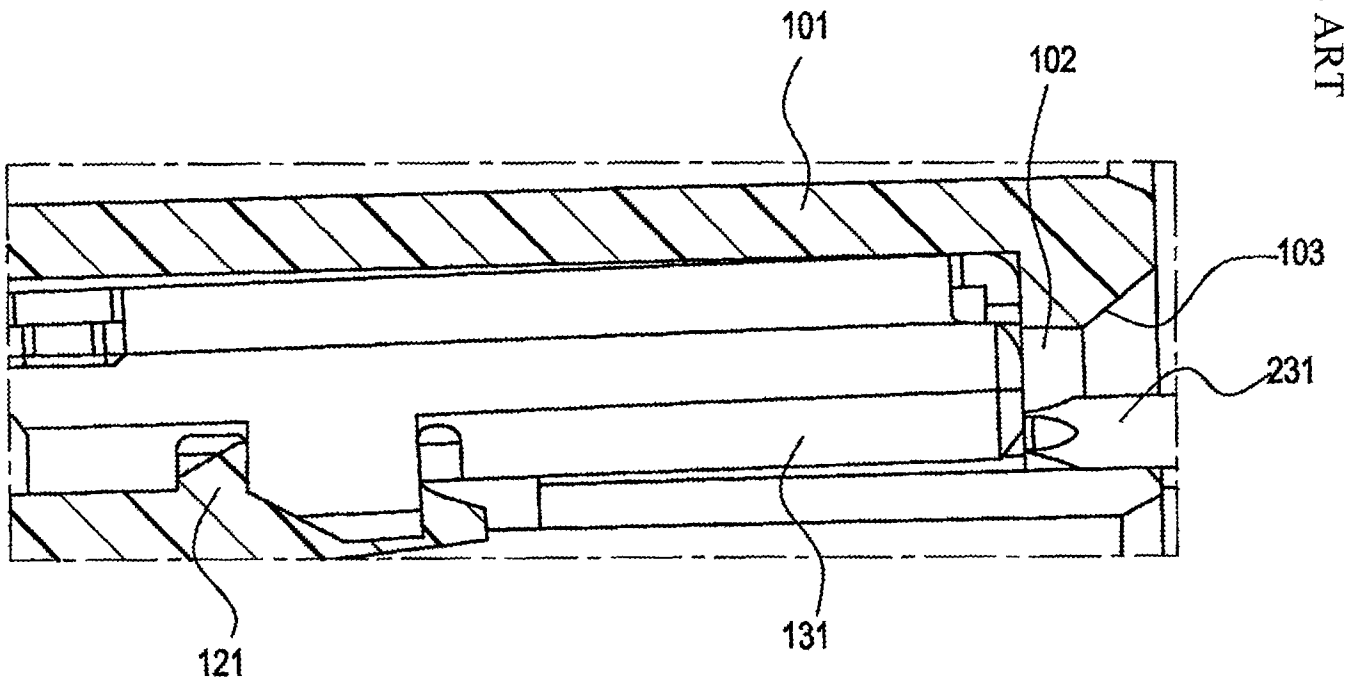
Fig.18 CONVENTIONAL ART
FIG. 18 is an enlarged view showing the colliding state of a tab and a terminal fitting portion shown in FIG. 17.

FIG. 11 is a vertical sectional view showing a state in which when the first housing and a second housing which are described in the embodiment are fitted together for connection with respective axes inclined in a vertical direction (a top-to-bottom direction), a tab of the male tab terminal within the second housing is smoothly guided into a terminal fitting portion of the female connector terminal by a tapered guide surface of the first housing, FIG. 12 is am enlarged view of a portion G shown in FIG. 11, FIG. 13 is a horizontal sectional view showing a state in which when the first housing and the second housing which are described in the embodiment are fitted together for connection with the respective axes inclined in a horizontal direction (a widthwise direction), the tab of the male tab terminal within the second housing is smoothly guided into the terminal fitting portion of the female connector terminal by a tapered guide surface of the first housing, and FIG. 14 is an enlarged view of a portion H shown in FIG. 13.

As shown in FIG. 1, a connector 1 of this embodiment includes a male tab terminal 10, a female connector terminal 20, a female housing 30 functioning as a first housing which accommodates and holds the female connector terminal 20, and a male housing 40 functioning as a second housing which accommodates and holds the male tab terminal 10 and which is fitted on the first housing for connection.

The male tab terminal 10 is a pressed part which is pressed from a sheet of metal and includes, as shown in FIGS. 5 to 7, a rod-shaped tab 11 which is formed at a distal end (a left end in FIG. 7) thereof, an intermediate portion 12 of an angular tube construction which is provided continuously to a proximal end side of the tab 11, and an electric wire crimping portion 14 which is provided continuously to a proximal end side of the intermediate portion 12.

A chamfer 15 is provided at a distal end portion of the tab 11 so as to facilitate the fitting of the tab 11 into the female connector terminal 20, which will be described later.

A lance engagement hole 16, which is a second lance engagement portion with which a projecting portion of a male terminal locking lance, which will be described later, is brought into engagement, is formed in an upper surface 12*a* of the intermediate portion. This lance engagement hole 16 is a substantially quadrangular opening and is not formed symmetrical with respect to a center axis C10 of the male tab terminal 10 shown in FIG. 6 but is formed so as to deviate in a widthwise direction (refer to FIG. 5). Additionally, in the case of this embodiment, the lance engagement hole 16 is formed in such a way as to cut out an upper edge portion of a side wall portion 12*b* which is one of side wall portions of the intermediate portion 12 so that the projecting portion of the male terminal locking lance, which will be described later, can also be brought into engagement with the side wall portion 12*b*.

A distal end edge portion of the lance engagement hole 16 constitutes a lance engagement surface 16*a* which is brought into engagement with the projecting portion of the male terminal locking lance to thereby realize the prevention of the dislocation of the male tab terminal.

The electric wire crimping portion 14 includes a conductor crimping piece 17 which is crimped to a conductor of an electric wire and a sheath crimping piece 18 which is crimped to a sheath portion of the electric wire.

Incidentally, the female connector terminal 20 is a pressed part which is pressed from a sheet of metal and includes, as shown in FIGS. 8 to 10, an angular tube-shaped terminal fitting portion 21 which is formed at a distal end (a left end in FIG. 10) thereof, a lance engagement hole 23 which is formed in an upper surface 21*a* in a position lying closer to a proximal end of the terminal fitting portion 21, and an electric wire crimping portion 24 which is provided continuously to the proximal end of the terminal fitting portion 21.

The terminal fitting portion 21 has an angular tube construction into which the tab 11 at the distal end of the male tab terminal 10 can be fitted and the tab 11 is fitted into the terminal fitting portion 21 for connection. A push spring piece 26 is provided in an interior of the terminal fitting portion 21 so as to push up the tab 11 inserted towards the upper surface 21*a* to thereby realize an electric communication or connection with the tab 11.

The lance engagement hole 23 is a lance engagement portion with which a female terminal locking lance 32 of the female housing 30, which will be described later, is brought into engagement. This female terminal locking lance 32 is a substantially quadrangular opening and is not formed symmetrical with respect to a center axis C20 of the female connector terminal 20 shown in FIG. 9 but is formed so as to deviate in a widthwise direction. In addition, in the case of this embodiment, the lance engagement hole 23 is a lance engagement portion with which a projecting portion of the female terminal locking lance, which will be described later, is brought into engagement. The lance engagement hole 23 is formed in such a way as to cut out an upper edge portion of a side wall portion 21*b* which is one of side wall portions of the terminal engagement portion 21 so as to also be brought into engagement with the side wall portion 21*b*.

A distal end edge portion of the lance engagement hole 23 constitutes a lance engagement surface 23*a* which is brought into engagement with the projecting portion of the male terminal locking lance so as to realize the prevention of dislocation thereof.

The electric wire crimping portion 24 includes a conductor crimping piece 27 which is crimped to a conductor of an electric wire and a sheath crimping piece 28 which is crimped to a sheath portion of the electric wire.

The female housing 30 is an injection molded part which is injection molded from a plastic material and includes, as shown in FIGS. 1 to 4, a female terminal accommodation hole 31, the female terminal locking lance 32, a tab insertion opening 33 and a tapered guide surface 34.

The female terminal accommodation hole 31 is a hole which accommodates the female connector terminal 20. This female terminal accommodation hole 31 is opened to a rear end face (a proximal end face) 30*a* of the female housing 30, and the female connector terminal 20 is inserted from a housing rear end.

As shown in FIG. 3, the female terminal locking lance 32 is provided within the female terminal accommodation hole 31 and includes an elastic piece 32*a* which extends along a longitudinal direction of the female terminal accommodation hole 31 and a projecting portion 32*b* which projects from the elastic piece 32*a* towards the center of the female terminal accommodation hole 31. This female terminal locking lance 32 prevents the dislocation of the female connector terminal 20 by the engagement of the lance engagement surface 23*a* of the female connector terminal 20 with the projecting portion 32*b*.

The tab insertion opening 33 is a hole having a quadrangular cross-sectional shape which is formed in a distal end of the housing so as to penetrate therethrough so that the tab 11 is allowed to be inserted into the terminal fitting portion 21 of the female connector terminal 20 held in the female terminal accommodation hole 31. The tab insertion opening 33 communicates with the female terminal accommodation hole 31.

The tapered guide surface 34 is a tapered surface which functions, when a distal end of the tab 11 is brought into abutment therewith, to guide the tab 11 in abutment therewith towards the center of the tab insertion opening 33. As shown in FIG. 4, this tapered guide surface 34 is made up of four guide surfaces 34*a*, 34*b*, 34*c*, 34*d* which correspond to four sides of an opening edge of the tab insertion opening 33. The guide surface 34*a* is a tapered surface which continuously connects to an upper side of the opening edge of the tab insertion opening 33. The guide surface 34*b* is a tapered surface which continuously connects to a lower side of the opening edge of the tab insertion opening 33. The guide surface 34*c* is a tapered surface which continuously connects to a left side (a side situated on a left-hand side in FIG. 4) of the opening edge of the tab insertion opening 33. The guide surface 34*d* is a tapered surface which continuously connects to a right side (a side situated on a right-hand side in FIG. 4) of the opening edge of the tab insertion opening 33.

In the case of this embodiment, the projecting portion 32*b* of the female terminal locking lance 32 has a width W2 along a terminal widthwise direction as shown in FIG. 4. Additionally, a center axis C32 of the projecting portion 32*b* (the female terminal locking lance 32) is formed so as to deviate leftwards in the widthwise direction of the female connector terminal 20 (leftwards in FIG. 4) with respect to a center axis C31 of the female terminal accommodation hole 31. Consequently, a positional deviation of a dimension d2 is generated between the center axis C32 and the center axis C31 as shown in FIG. 4.

In the case of the female connector terminal 20 of this embodiment, the lance engagement hole 23 with which the projecting portion 32*b* of the female terminal locking lance 32 is brought into engagement is provided so as to deviate in the terminal widthwise direction from a center axis C20 of the female connector terminal 20 shown in FIG. 9 according to the deviation amount d2 of the center axis C32 with respect to the center axis C31.

As shown in FIGS. 1 and 2, the male housing 40 includes a male terminal accommodation hole 41 which accommodates the male tab terminal 10 and a male terminal locking lance 42 which is provided within the male terminal accommodation hole 41.

The male terminal locking lance 42 includes an elastic piece 42*a* which extends along a longitudinal direction of the male terminal accommodation hole 41 and a projecting portion 42*b* which projects from this elastic piece 42*a* towards the center of the male terminal accommodation hole 41. The male terminal locking lance 42 prevents the dislocation of the male tab terminal 10 by the engagement of the projecting portion 42*b* with the lance engagement surface 16*a* of the male tab terminal 10.

In the case of this embodiment, although not shown, as with the female terminal locking lance 32 of the female housing 30, the male terminal locking lance 42 is formed so as to deviate in a widthwise direction of the male tab terminal 10 with respect to a center axis of the male terminal accommodation hole 41.

In the case of the male tab terminal 10 of this embodiment, as described above, the lance engagement hole 16 which is a second lance engagement portion with which the male terminal locking lance 42 is brought into engagement is provided so as to deviate in the terminal widthwise direction from a center axis of the male tab terminal 10. This deviation amount of the lance engagement hole 16 corresponds to the aforesaid deviation amount d2 of the male terminal locking lance 42 with respect to the male terminal accommodation hole 41.

In the case of the connector 1 that has been described heretofore, in the female housing 30, the female terminal locking lance 32 is formed so as to deviate in the widthwise direction of the female connector terminal 20 with respect to the center axis of the female terminal accommodation hole 31 as shown in FIG. 4.

Because of this, even though the width of the female terminal locking lance 32 is increased to the widthwise dimension W2 shown in FIG. 4 in order to increase the holding force of the lance which holds the female connector terminal 20, it is possible to ensure the tapered guide surface 34*b* which guides the tab 11 of the male tab terminal 10 to the center of the tab insertion hole 33 at the lower edge portion of the opening edge of the tab insertion opening 33. Because of this, it is possible to ensure the construction in which the guide surfaces 34*a*, 34*b*, 34*c*, 34*d* are provided individually on the four sides of the opening edge of the tab insertion opening 33 as shown in FIG. 4.

Because of this, as shown in FIGS. 11 and 12, even though both the housings are fitted together with the axis of the male housing 40 inclined vertically relative to the female housing 30, causing a situation in which the distal end of the tab 11 is brought into collision with an upper edge or lower edge of the opening edge of the tab insertion opening 33, there will be caused no problem. Namely, the tab 11 is guided towards the center of the tab insertion opening 33 by the upper and lower guide surfaces 34*a*, 34*b* of the opening edge of the tab insertion opening 33, thereby making it possible to smoothly guide the tab 11 into the terminal fitting portion 21 of the female connector terminal 20.

In addition, as shown in FIGS. 13 and 14, even though both the housings are fitted together with the axis of the male housing 40 inclined in a left-to-right widthwise direction relative to the female housing 30, causing a situation in which the distal end of the tab 11 is brought into collision with the left and right edges of the opening edge of the tab insertion opening 33, there will be caused no problem. Namely, the tab 11 is guided towards the center of the tab insertion opening 33 by the left and right guide surfaces 34*c*, 34*d* of the opening edge of the tab insertion opening 33, thereby making it possible to smoothly guide the tab 11 into the terminal fitting portion 21 of the female connector terminal 20.

Namely, in the connector 1 that has been described heretofore, even though the housings are fitted together with the tab 11 inclined vertically or horizontally relative to the female connector terminal 20, the tab 11 can smoothly be fitted into the female connector terminal 20 for connection.

Consequently, in the connector 1 that has been described heretofore, even though the width of the female terminal locking lance 32 is increased so as to increase the holding force of the lance which holds the female connector terminal 20, a reduction in fitting performance between the female connector terminal 20 and the male tab terminal 10 is not called for.

In other words, in the connector 1 that has been described heretofore, the holding force of the lance which holds the female connector terminal 20 can be increased without reducing the fitting performance between the female connector terminal 20 and the male tab terminal 10.

In addition, in the connector 1 that has been described heretofore, also in the male housing 40 which accommodates the male tab terminal 10, since the male terminal locking lance 42 is provided so as to deviate in the widthwise direction with respect to the male terminal accommodation hole 41, as with the female housing 30, the width of the male terminal locking lance 42 with which the male tab terminal 10 is brought into engagement can be increased, thereby making it possible to easily increase the holding force to holds the male tab terminal 10.

Consequently, in both the female housing 30 and the male housing 40 which are fitted together, the holding force to hold the connector terminals accommodated therein can be increased, as a result of which when both the housings are fitted together, the occurrence of an inadvertent looseness of the male tab terminal 10 and the female connector terminal 20 in the corresponding housings can be prevented, thereby making it possible to enhance the electric connectivity thereof.

The invention is not limited to the embodiment and hence can be modified or improved as required. In addition, the materials, configurations, dimensions, numbers and disposition locations of the constituent elements described in the embodiment are arbitrary and hence the invention is not limited thereto, provided that the invention can be attained.

For example, the deviation amount of the female terminal locking lance 32 with respect to the female terminal accommodation hole 31 in the female housing 30 can be altered in design to an appropriate amount according to a holding force required to hold the female connector terminal 20.

While the invention has been described in detail or by reference to the specific embodiment, it is obvious to those skilled in the art that various alterations or madefications can be made thereto without departing from the spirit and scope of the invention.

This patent application is based upon Japanese Patent Application (No. 2011-075925) filed on Mar. 30, 2011, the contents of which are incorporated herein by reference.

INDUSTRIAL APPLICABILITY

According to the connector of the invention, even though the width of the female terminal locking lance is increased in order to increase the holding force of the lance which holds the female connector terminal, it is possible to ensure the tapered guide surface which guides the tab of the male tab terminal to the center of the tab insertion opening at the lower edge portion of the opening edge of the tab insertion opening. Because of this, the invention is useful in the field of connectors equipped with a female terminal locking lance.

DESCRIPTION OF REFERENCE NUMERALS

1 connector
10 male tab terminal
11 tab
16 lance engagement hole (second lance engagement portion)
16*a* lance engagement surface
20 female connector terminal
21 terminal fitting portion
23 lance engagement hole (lance engagement portion)
23*a* lance engagement surface
30 female housing (first housing)
31 female terminal accommodation hole
32 female terminal locking lance
32*b* projecting portion
33 tab insertion opening
34 guide surface
34*a*, 34*b*, 34*c*, 34*d* guide surface
40 male housing (second housing)
41 male terminal accommodation hole
42 male terminal locking lance
42*b* projecting portion.

The invention claimed is:

1. A connector comprising:

a female connector terminal having at a distal end a terminal fitting portion into which a tab that is provided at a distal end of a male tab terminal is fitted for connection; and a first housing which accommodates and holds the female connector terminal;

wherein the first housing includes a female terminal accommodation hole which accommodates the female connector terminal, a female terminal locking lance which is provided within the female terminal accommodation hole so as to be brought into engagement with the female connector terminal thereby preventing dislocation of the female connector terminal, a tab insertion opening which is formed at a distal end of the first housing so as to penetrate therethrough so that the tab is inserted into the terminal fitting portion of the female connector terminal held in the female terminal accommodation hole, and a tapered guide surface formed at an opening edge of the tab insertion opening;

wherein, in the first housing, the female terminal locking lance is formed so as to deviate in a widthwise direction of the female terminal locking lance with respect to the center axis of the female terminal accommodation hole, and wherein, in the female connector terminal, a lance engagement portion where the female terminal locking lance is brought into engagement is provided so as to deviate in the widthwise direction of the female terminal locking lance from the center axis of the female terminal accommodation hole.

2. The connector according to claim 1, further comprising:

the male tab terminal; and a second housing which accommodates and holds the male tab terminal and which is fitted on the first housing for connection;

wherein the second housing includes a male terminal accommodation hole which accommodates the male tab terminal and a male terminal locking lance which is provided within the male terminal accommodation hole so as to be brought into engagement with the male tab terminal to so as to prevent the dislocation of the male tab terminal, wherein the male terminal locking lance is formed so as to deviate in a widthwise direction of the male tab terminal with respect to a center axis of the male terminal accommodation hole; and wherein, in the male tab terminal, a second lance engagement portion where the male terminal locking lance is brought into engagement is provided so as to deviate in a terminal widthwise direction from the center axis.

3. The connector according to claim 1, wherein the female terminal locking lance is configured to be off-center with respect to the center axis of the female terminal accommodation hole.

4. The connector according to claim 3, wherein the lance engagement portion is a hole off-center with respect to the center axis of the female terminal accommodation hole.

5. The connector according to claim 2, wherein the male terminal locking lance is off-center with respect to the center axis of the male terminal accommodation hole.

6. The connector according to claim 5, wherein the second lance engagement portion is a hole off-center with respect to the center axis of the male terminal accommodation hole.

* * * * *